United States Patent [19]

Roen et al.

[11] Patent Number: 4,717,262

[45] Date of Patent: Jan. 5, 1988

[54] FLAT BOTTOM PLASTIC BAG AND METHOD OF MAKING SAME

[75] Inventors: Ralph M. Roen; Terry D. Gebhardt, both of Longview, Tex.

[73] Assignee: T.C. Manufacturing Company, Inc., Evanston, Ill.

[21] Appl. No.: 1,856

[22] Filed: Jan. 9, 1987

[51] Int. Cl.[4] ..... B65D 30/20; B65D 30/16

[52] U.S. Cl. ..... 383/120; 383/104; 383/121

[58] Field of Search ..... 383/120, 121, 125, 907, 383/9, 104

[56] References Cited

U.S. PATENT DOCUMENTS

| | | | |
|---|---|---|---|
| 2,412,501 | 12/1946 | Gardner | 93/35 |
| 3,003,907 | 10/1961 | La Fleur | 156/537 |
| 3,143,277 | 8/1964 | La Fleur | 229/57 |
| 3,321,354 | 5/1967 | Sloan et al. | 156/499 |
| 3,381,886 | 5/1968 | Goglio | 229/57 |
| 3,435,736 | 4/1969 | Reiche | 93/35 |
| 3,580,486 | 5/1971 | Kugler | 383/120 |
| 3,606,822 | 9/1971 | Platz et al. | 93/35 SB |
| 3,618,478 | 11/1971 | Piazze | 383/120 |
| 3,660,959 | 5/1972 | La Fleur | 53/14 |
| 3,669,347 | 6/1972 | Platz et al. | 229/58 |
| 3,738,565 | 6/1973 | Ackley etal. | 229/55 |
| 3,739,977 | 6/1973 | Shapiro et al. | 229/55 |
| 3,743,172 | 7/1973 | Ackley et al. | 229/55 R |
| 3,853,664 | 12/1974 | La Fleur | 156/306 |
| 3,915,077 | 10/1975 | La Fleur et al. | 93/8 R |
| 3,924,521 | 12/1975 | Hanson et al. | 93/35 SB |
| 3,970,241 | 7/1976 | Hanson | 229/58 |
| 4,125,220 | 11/1978 | Suominen | 383/9 |
| 4,262,581 | 4/1981 | Ferrell | 493/188 |
| 4,526,565 | 7/1985 | Hummel et al. | 493/196 |
| 4,554,192 | 11/1985 | Benoit | 383/121 |

FOREIGN PATENT DOCUMENTS

| | | | |
|---|---|---|---|
| 1409321 | 7/1965 | France | 383/121 |

*Primary Examiner*—Willis Little

[57] ABSTRACT

A flat bottom plastic bag of two sided panel construction with the bottom of the bag formed by a gussett extending between the sealed ends of the bag, at which point the bag side panels are joined together, with the bag bottom gusset having a central fold line that is, in the flattened relation of the bag, disposed between the lower portions of the bag side panels, and that in such relation forms a first pair of adjacent bag plies that includes one of said bag side panel lower portions, and a second pair of bag plies that includes the lower portion of the other bag side panel, with said respective sets of bag plies being respectively joined together but free of adherence to each other by diagonally extending heat seals on either side of the bag that extend diagonally from the bag respective ends in converging relation to adjacent the respective bottom edgers of the bag that are defined by the respective bag plies. The bag has its ends formed by heat sealing the two bag side panels together at the bag ends along lines extending normally of the bag bottom, with the bag side panels also being severed across the top of same to both define the bag open end and a curved handle type open top of the bag. Also disclosed is a method of making a plurality of such bags from flattened plastic film tube stock, with no waste of the film material of the stock, and with the bags to be formed extending transversely of the tube stock.

4 Claims, 11 Drawing Figures

FLAT BOTTOM PLASTIC BAG AND METHOD OF MAKING SAME

The present invention is directed to a flat bottom bag formed from plastic film tube stock, and the method of making same, and more particularly, the invention relates to a plastic film bag that is gusseted and heat sealed so as to be flat in its closed relation for ease of storage until needed, which when open, defines an open top and a flat bottom, and that is free standing to facilitate filling the bag through its open top.

The prior art contains a number of illustrations of bags of this type, which are usually formed from tubular film stock made from a suitable thermoplastic material such as polyethylene, as well as methods and machines for making such bags. See, for instance, Platz et al. U.S. Pat. Nos. 3,606,822 and 3,669,347, Goglio U.S. Pat. No. 3,381,886, Ackley et al. U.S. Pat. No. 3,743,172, Hanson U.S. Pat. No. 3,924,521, McCutcheon Sloan et al. U.S. Pat. No. 3,321,354, Ackley et al. U.S. Pat. No. 3,738,565, Ferrell U.S. Pat. No. 4,262,581, Weis et al. U.S. Pat. No. 3,509,799, LaFleur U.S. Pat. Nos. 3,003,907, 3,143,277, and 3,853,664, LaFleur et al. U.S. Pat. No. 3,915,077 and Hummell U.S. Pat. No. 4,526,565.

A principal object of the present invention is to provide a flat bottom bag formed from tubular film stock that may be conveniently made from polyethylene or the like, a method of making the bag from such film stock, in which the bag is of one piece plastic film construction defined by a pair of side panels that are joined together at the bottom of the bag by being in one piece relation with a continuous gusset that extends between the bag ends, with the side panels being joined together along the ends of the bag by heat seals that extend normally of the bag bottom, and with the bag side panels being free of each other across the top of the bag to define the open end of the bag.

A further principal object of the invention is to provide a bag of the type indicated, and method of making same, in which the bag is essentially of one piece construction comprising a pair of side panels connected together across the bottom of the bag by a gusset that extends continuously and imperforately across the bottom of the bag in one piece construction relation thereto, which gusset defines on either side of the bag lower portion bag plies that are respectively heat sealed together, but free of heat sealing the sets of bag plies to each other, with such heat seals being along diagonal seals that extend from the respective bag ends to adjacent the respective bag bottom edgings defined by the respective sets of bag plies, for providing a bag bottom, when the bag is opened, that includes an outer margin that is in circumambient relation to a flattened out central portion of the bag bottom gusset, whereby when the bag is opened it is shaped for free standing in such open relation for ease of application of groceries or the like thereto.

Another principal object of the invention is to provide a bag of the type indicated in which the bag comprises side panels that are severed across the top of the bag to both form the open end of the bag and to define a curved handle arrangement for both side panels of the bag that is centered relative to the bag length dimension for automatic balancing of the bag when it is filled with groceries or the like.

Yet another principal object of the invention is to provide a method of making flat bottom bags from tubular stock formed from a plastic film material such as polyethylene in which the bags are formed along the length of the tube stock without waste of the film material involved, and with the bag forming procedure including the formation of a pleat along each edging of the tube stock, or what is to be the tube stock, and the defining of the individual bags along the tube stock is such that the bags are formed to extend transversely of the tube stock, with the bottoms of alternate bags being formed by the tube stock edging pleating that form bottom gussets of the individual bags, which gussets are also heat sealed along diagonal weld lines that converge from the respective ends of the bag to lower marginal edges of the respective side panels of the bag, whereby the individual bags are free standing when they are opened for filling the bag.

In accordance with the invention, a flat bottom bag of integral one piece construction is formed from heat sealable tubular plastic material, such as polyethylene or its equivalent, with the bag comprising a pair of side panels that are integrally joined together in one piece construction thereto along the bag bottom by a continuous gusset having a central fold line that is, in the flattened relation of the bag where the bag side panels are in closely spaced relation, disposed between the lower portions of the bag side panels and within the bag bottom. The bag gusset and the bag side panels are of substantially the same dimension across the width of the bag as measured between its sealed ends, with the bag ends being defined by the bag side panels being welded together at seams that extend substantially normally of the bag bottom in the flattened relation of the bag.

The bag gusset, between the respective bottom edgings of the bag side panels and the indicated central fold line, in the flattened relation of the bag defines a pleat forming a pair of in-fold panels, one of which opposes the lower portion of one of the bag side panels, to form a first pair of adjacent bag plies, and the other of which opposes the lower portion of the other of the bag side panels to form a second pair of bag plies.

A feature of the invention is that the indicated first pair of bag plies is joined together free of adherence to the second pair of bag plies along heat seals that extend diagonally from adjacent the bag ends to adjacent the bottom edging of the bag indicated one side panel, and the other pair of bag plies are joined together free of adherence to the first pair of bag plies, again along heat seals that extend diagonally from adjacent the bag ends to adjacent the bag edging of the indicated bag other side panel.

The bag side panels are shaped across the top of the bag to define congruent upper end portions that include convexly contoured parabolically shaped top edges that are centered relative to the length dimension of the bag, with the bag side panel top edgings both being separated from each other to define the open end of the bag and also being formed to define congruently located and centered apertures for forming centered hand holds for either side of the bag.

Further in accordance with the invention, the bags of the present invention are formed from flattened tube stock in waste free crosswise extending relation, with the bags being formed along the respective side edges of the tube stock relation to have their bottoms shaped out of the stock side edges, that define the indicated bag bottom gussets, and with the bag side panels being free of each other across the top of the bag to define the bag open end and being of complementary arcuate shaping including a central convexly contoured parabolic shaped portion in which bag side wall handle forming apertures are formed which congruently centered on either side of the bag. The bags are cut out of the tube stock consecutively in pairs and stacked for use or packaging as desired. The tube stock once formed may be temporarily stored on a roll up roller and later unrolled for individual formation of the bags in accordance with the invention.

Other objects, uses and advantages will be obvious or become apparent from a consideration of the following detailed description and the application drawings, in which like reference numerals indicate like parts throughout the several views.

IN THE DRAWINGS

FIG. 1 is a diagrammatic perspective view of a flat bottom bag made in accordance with the present invention shown in its open upright relation when the bag has been forced open from its normal flat relation by grasping the handles at its open end and moving same forcibly through the air to catch air within the bag to open the bag for resting on a suitable flat support surface, and in a self maintaining upright relation of the type that is shown in FIG. 1, with the bag bottom gusset, and the diagonal heat seal welds that are formed on either side of the bag being illustrated diagrammatically in dashed lines;

Figure 8:
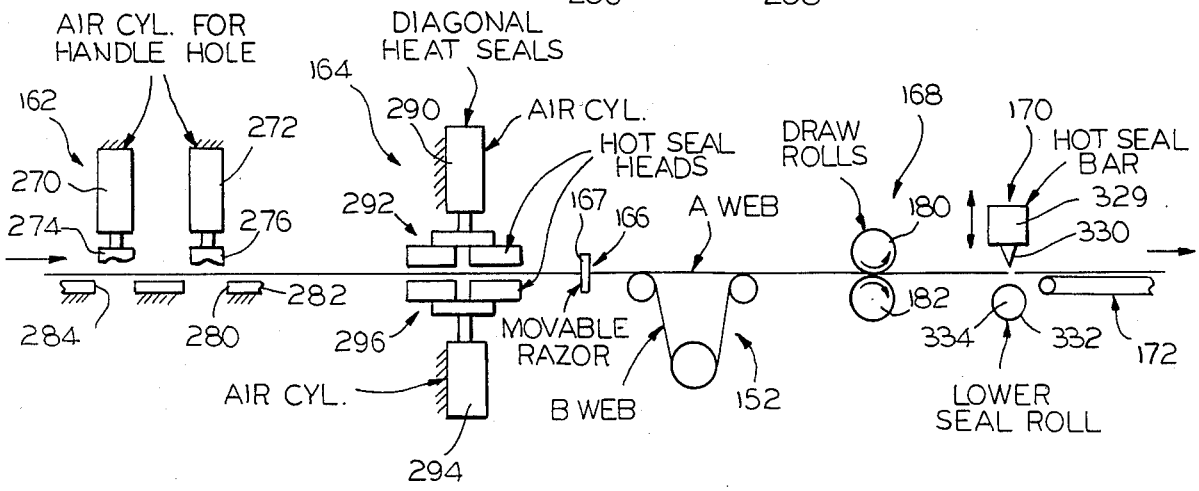
FIG. 8 is a diagrammatic view that is somewhat schematic and block diagram in character showing one arrangement for practicing the method aspects of this invention in forming bags of the type shown in FIGS. 1–4.
Figure 10:
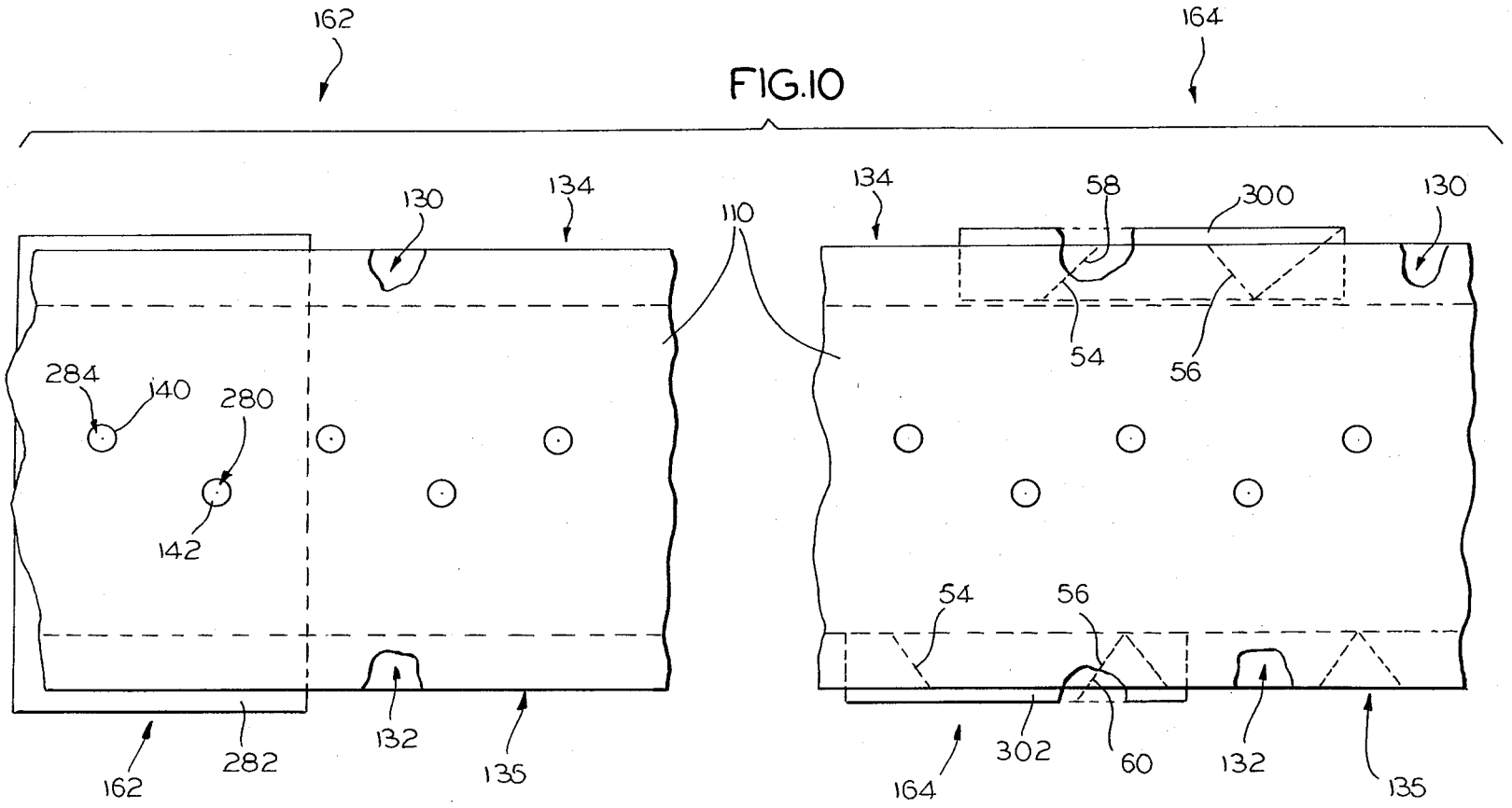
Figure 11:
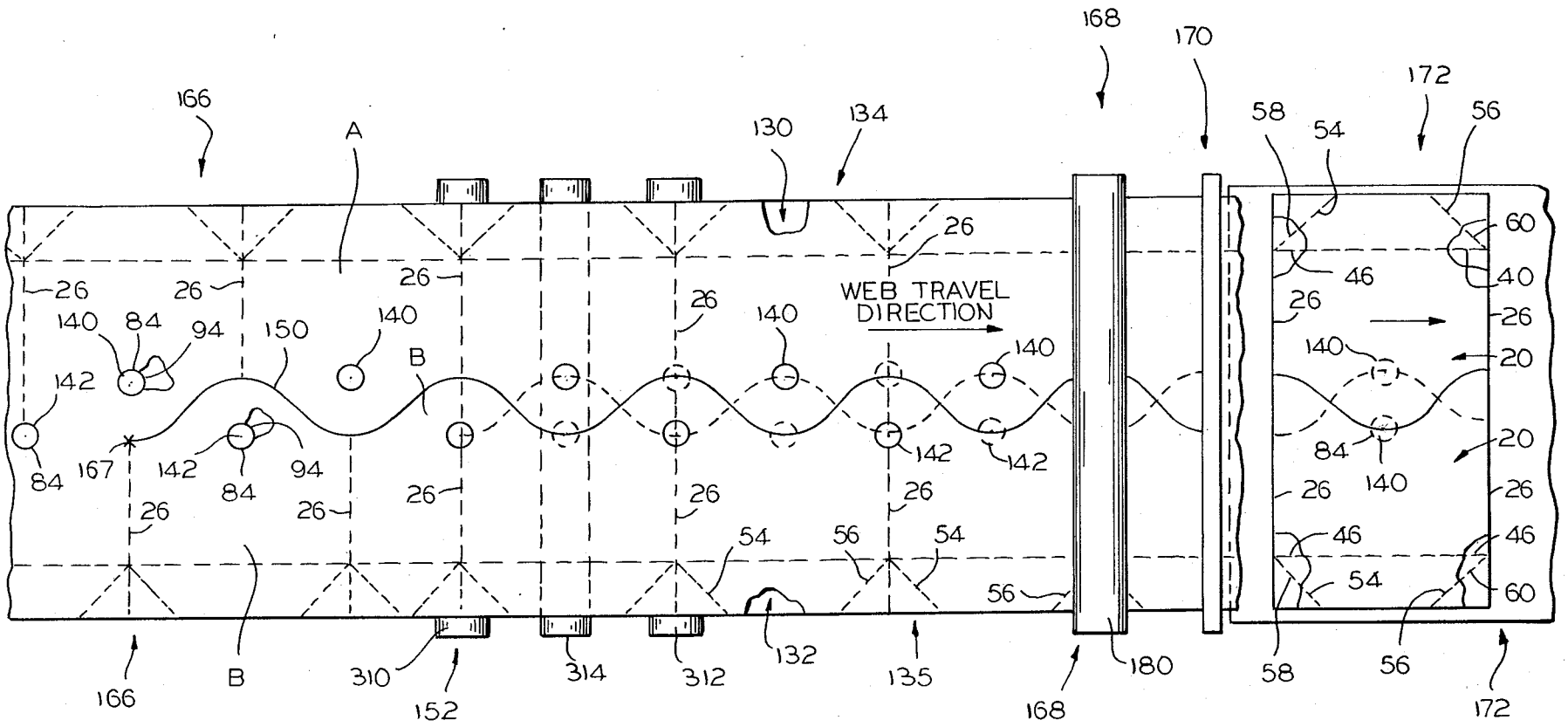

FIG. 10 is a plan view of portions of the bag stock shown in FIG. 8, indicating the manner in which the bag handle defining apertures and the bag bottom gusset diagonal heat seal welds are formed along the length of the tube stock as it is processed in connection with the methods of the present invention; and, FIG. 11 is a view similar to that of FIG. 10 illustrating how the bag stock is split into two webs, by a reciprocating cutting device, and one of the webs is delayed in its forward movement one-half a bag width so that a pair of bags may be simultaneously cut and sealed at their side edges from the leading end of the tube stock to complete the bag forming steps involved.

However, it is to be distinctly understood that the specific drawing illustrations provided are supplied primarily to comply with the requirements of the Patent Laws, and that the invention is susceptible of other embodiments or modifications that will readily be apparent to those skilled in the art, and which are intended to be covered by the appended claims.

GENERAL DESCRIPTION

The bag and method of the present invention contemplate the formation of plastic so-called "flat bottom" bags of special design and configuration, that are formed from plastic film tube stock of a selected thickness and material in accordance with the present state of the art in connection with the manufacture of plastic bags. Suitable materials for forming the bag stock are considered to be materials such as polyethylene, polypropolyene, or their equivalents having a thickness range of between 0.3 mils to about 0.6 mils, for example. While the size of the bag formed in accordance with the present invention may vary in accordance with the particular usage for which the bag is intended, the invention contemplates that the bag will be formed to comprise essentially two opposed side panels that are continuously and integrally connected together across the bottom of the bag by an imperforate gusset of pleat configuration, and that are heat seal welded together along transverse edges that extend normally of the gusset and form the ends of the bag. The said bag ends are substantially equal in length height-wise of the bag, and above the upper portion of the said bag side edges, the bag side panels define curvilinear unattached edgings that form the open end of the bag and that include congruent convexly contoured parabolically shaped top edges that are centered relative to the length dimension of the bag which are formed to define congruently located apertures for forming handles for the bag.

As to the bag bottom gusset, the invention contemplates that the gusset has a central fold line that is, in the flattened relation of the bag, (wherein the bag side panels are in closely spaced relation), disposed between the lower portions of the respective bag side panels within the bag bottom. The indicated bag gusset between the respective bottom edgings of the bag side panels and the central fold thereof define a pair of in-fold panels, one of which opposes the lower portion of one of the bag side panels to form a first pair of adjacent bag plies in the flattened relation of the bag, and the other of which opposes the lower portion of the other of the bag side panels to form a second pair of bag plies in the indicated flattened relation of the bag.

A feature of the present invention is that for each bag, at the bag side panel lower portions and the gusset, the indicated first pair of bag plies are joined together free of adherence to the second pair of bag plies along heat seals that extend diagonally from adjacent the bag ends to adjacent the bag bottom edgings of the respective bag side panels with, for each bag, such heat seal extending in a converging direction downwardly of the bag.

This relationship of the bag and its component parts accommodates the individual bags being disposed in totally flattened relation for easy storage and packing until needed, as the bag bottom gusset retains its in-folding pleat configuration.

When use of the bag is needed, for instance, for a load of groceries, the bag may be picked up by grasping its handle forming apertures that are at its open end, drawn briskly in roughly a circular direction to catch in the bag the quantity of ambient air that snaps the bag open to its open relation for receiving a bag load (a familiar way of quickly opening so called "flat bottom" bags).

When the bag of the present invention is snapped into open relation in the manner now familiar for flat bottom bags, the arrangement of the bag bottom and the bag side panels is such that the bag bottom is shaped to define across its midportion, including the gusset in-fold line at the bag midportion, a more or less flat portion that cooperates with the side panel lower edgings that have been, for each bag side panel, disposed in a generally convex relation about the lower perimeter of the bag. Thus, when the opened bag is placed on a flat supporting surface, such as that defined by a typical support panel of a market checkout counter or the like, the opened bag rests on the support panel with its gusset midportion and side panel lower edgings (that are in circumambient relation about the gusset midportion in such open position of the bag) cooperating to support the bag in its open relation. The bag stays in open relation and its side panels are shaped for self bracing relationships for holding the bag open to receive a load of groceries or the like. When the bag load has been placed within the bag, the bag may be grasped by the handle forming apertures formed in the bag side panels, and carried off, with the location of the bag handle forming apertures being centered such that the bag load is automatically centered within the bag for effective carrying purposes. When the loaded bag is disposed on a table or the like for unloading, it remains in its upright open position for ease of unloading. When unloaded, the bag may be returned to its flattened relation for storage and reuse, if so desired. However, the cost of making the bag is so low that prompt disposal of the bag itself prevents no economic problem to, for instance, a grocery store or discount center customer.

The invention further contemplates that tubular bag stock of the type indicated is to be processed to form a multiple of such bags in identical form from the bag stock, substantially free of material waste, and with the bags, as formed from the bag stock, extending literally or crosswise of the stock, in adjacent, complementary form. The basic tube stock may be formed as part of the overall method or process of producing the bags, or the bag stock may be preformed, flattened and rolled up for processing as contemplated by the present invention. As has already been indicated, a key feature of the present invention so far as the method or process of making the bag is concerned is that the bag stock in its flattened relation has its side edges infolded to define opposed pleats that become the bag bottom gussets in the completed relation of the individual bags. As a further part of the processing procedure, the side edging in-fold pleats on either side edge of the bag stock are formed at the location on the stock of each bag to be formed therefrom, with pairs of diagonally oriented heat seals that seal the bag plies defined hereinbefore only on either side of the gusset, and not across the gusset. Also, the bag side panels are heat seal or heat seam welded together at the ends of the bag in normal relation to the respective bag forming gussets, and the bags are to be severed at their indicated ends as well as the bag side panel top edgings, which are to remain unbonded to define the open end of the bag. In the disclosed tube stock processing arrangement, the bags are formed from the tube stock, as already indicated, to extend transversely of the tube stock, but in staggered relation on either side of the tube stock to accommodate the formation of the bag open end defining edgings about the individual bag panel handle defining apertures, with the bags being formed, insofar as their open ends and end edgings are concerned, in complementary interfitting relation.

As part of the processing of the tube stock, the tube stock is split into two equivalent webs, after the bag handle forming apertures are formed in the tube stock, by a razor or knife that is reciprocated back and forth across the width of the tube stock to form a web separation sine wave configuration, with one of the webs being trained to delay its forward movement one-half a bag width so that at the leading end of the tube stock a pair of bags disposed on either side of the tube stock may be simultaneously cut from the tube stock by a common heat seal bar that seals the side edges of each bag so formed. The top edgings of the bags involved that define the open ends of the respective bags are severed without adherence to each other by the indicated sine wave configuration forming tube stock cutter, to form, as indicated, the open ends of the respective bags.

Referring now more specifically to the drawings, FIGS. 1–4 diagrammatically illustrate a single bag arranged in accordance with the invention, while FIGS. 5–11 are concerned with the method aspects of the invention, and specifically specific steps of the method in the processing of flattened tube stock formed from one of the plastic materials that has been indicated to provide the bags of FIGS. 1–4 for stacking in flattened relation for packaging and storage until needed.

THE BAG OF THE PRESENT INVENTION

Figure 1:
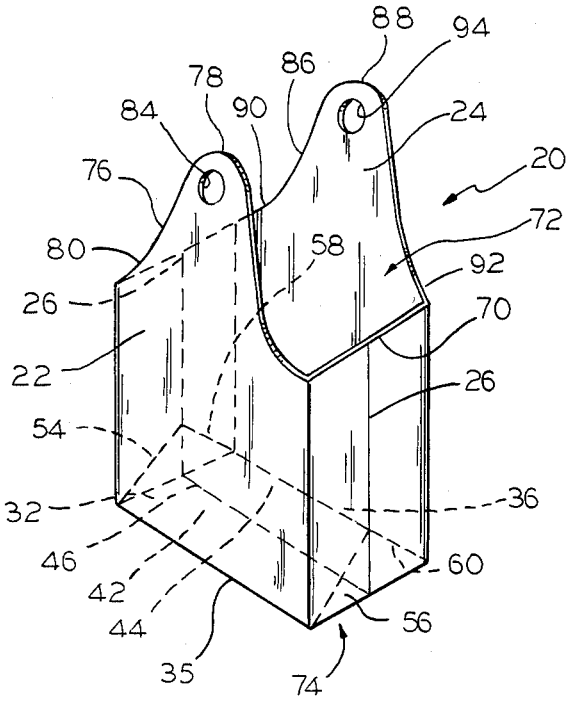
Figure 2:
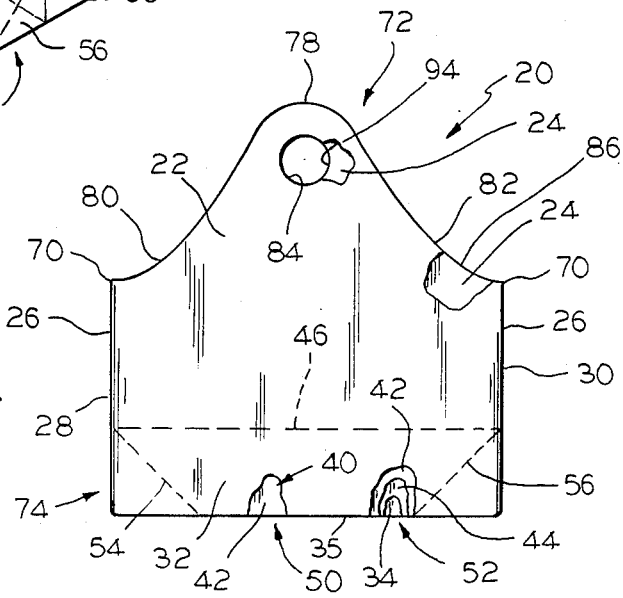
FIG. 2 is a plan view taken from one side of the bag showing the bag in its closed, or flattened relation, in which the two side panels of the bag are in closely spaced relation, and the bag bottom gussset is in its closed relation, with the gusset diagonal welds that are on either side of the bag, being indicated in dashed lines.
Figure 4:
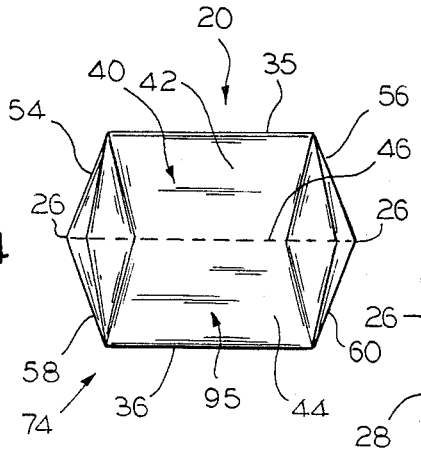
FIG. 4 is a bottom plan view of the bag when in its open relation better illustrating the flattened central portion of the bag gusset and the surrounding bag side panel lower edge portions that provide the flat bottom support for the bag of this invention.
Figure 3:
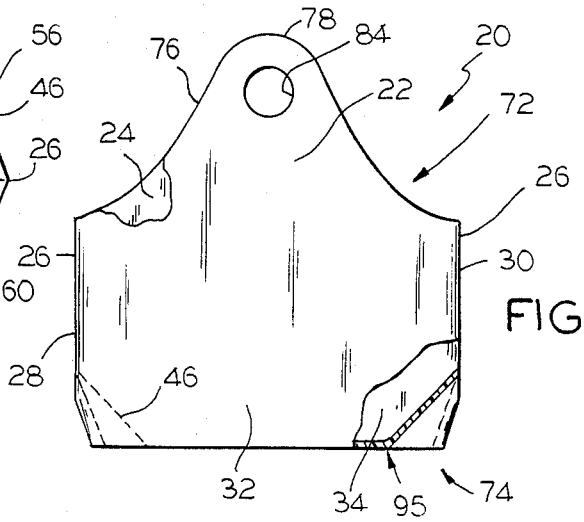
FIG. 3 is a side elevatiohal view, partially broken away of the bag of FIGS. 1 and 2 in its open relation, with the bag bottom gusset and associated diagonal welds being diagrammatically illustrated in the different configuration they assume in the open relation of the bag.

In FIGS. 1–4, flat bottom bag 20 is diagrammatically illustrated, with the bag 20 being shown in open relation in FIGS. 1, 3 and 4, and with the bag 20 being shown in flattened and closed relation in the showing of FIG. 2.

The bag 20 comprises side panels 22 and 24 that are joined together at the bag side end heat seals or seam welds 26 that form the side ends 28 and 30 of the bag. The side panels 22 respectively define lower portions 32 and 34, respectively, that each form the respective lower bag edgings 35 and 36 that are in one piece integral relation with bottom gusset 40 that extends between the side ends 28 and 30 of the bag, and that is closed by the end welds 26 at either end of the bag; the gusset 40 comprises a first panel 42 that in the flattened relation of the bag 20, in which the bag side panels 22 and 24 are in closely spaced relation, is in close adjacency with the lower portion 32 of the bag side panel 22. The gusset 40 also comprises an opposite panel 44 that is in one piece integral relation with the bag side panel 24 along its lower marginal edge portion 36, and which is disposed adjacent the lower portion 34 of the bag side panel 24 when the bag 20 is in its flattend relation.

The gusset panels 42 and 44 extend to and are in one piece relation with respect to each other, and at center located infold line 46 that in the flattened relation of the bag 20 is disposed within the bag 20 and between its side panels 22 and 24, and specifically the lower portions 32 and 34 thereof.

It will thus be seen that the bottom gusset 40 of the bag 20 in effect makes the side panels 22 and 24 continuous across the bottom of the bag, and in pleat form defines between the bag bottom edgings 35 and 36 a pair of in-fold panels 42 and 44, with the infold panel 42 opposing the lower portion 32 of the bag side panel 22 to form a first pair 50 of adjacent bag bottom plies (in the said flattened relation of the bag 20), and with the gusset panel 44 forming with the bag side panel or portion 34 (in the indicated flattened relation of the bag 20), a second pair 52 of bag plies (see FIG. 2). As indicated, the gusset panels 42 and 44 meet to define in-fold line 46 that forms the upper limit of the respective sets of bag plies 50 and 52 when the bag is in its flattened relation of FIG. 2.

An important aspect of the bag of the present invention is that the bag plies 50 are joined together on one side of the bag 20 by diagonal heat seals 54 and 56, while the plies 52 are joined together by a pair of identical heat seals 58 and 60, though the respective sets of bag plies 50 and 52 are free of adherence from each other. The result is that the bag 20 in its flattened relation has the layout configuration of FIG. 2, wherein the gusset 40 is in-folded within the bag 20 so that the bag 20 can be in a fully flattened relation, but when the bag is opened, the bottom of the bag as defined by the gusset 40 across the center of same, and the lower marginal edgings 35 and 36 of the bag that are defined by the bag side panels 22 and 24, give the bag the same sort of bottom support that those skilled in the art have come to expect from what are commonly known in this art as flat bottom bags, even though the bottom of the bag 20, because of the indicated diagonal welds 54 and 56 on one side of same, and the corresponding diagonal welds 58 and 60 on the other side of the same, prevent the entire bottom of the bag from actualy being disposed in flattened relation.

As indicated in FIG. 2, the diagonal seals 54 and 56 extend from the respective end seams 26 of the bag to the marginal edging 35 of the side panel 22; the opposite diagonal weld seams 58 and 60 on the other side of the bag are identically located with respect to the bag end seams 26 and the lower marginal edging 36 of the bag side panel 24.

Each bag 20 upwardly of the upper terminals 70 of the respective end seams 26 define upper marginal edgings that are free of each other to define the open end 72 of the bag 20, as distinguished from the bag closed end 74, which is formed by the appropriate nature of the side panels 22 and 24 and the gusset 40. Thus, the bag side panel 22 defines upper marginal edging 76 which is basically curvilinearly configured to define a convexly contoured parabolically shaped top edging portion 78 that is centered relative to the length dimension of the bag 20, as measured between its end seams 26, which convexly curved edge portion 78 merges into the concavely curved edge portions 80 and 82, of the side panel top edging 76 that terminate at the upper terminals 70 of the bag side edges 26. Further, the bag side panel 22 is formed with a hand hold defining circular aperture 84 that is concentrically located with respect to the upper marginal edge curvilinear portion 78.

The upper portion of the bag side panel 24 is similarly formed to define upper edging 86 comprising the convexly contoured parabolically shaped top edge portion 88 which smoothly merges into the concavely contoured top edge portions 90 and 92 of the side panel edge portion 86. Side panel 24 is formed to define the aperture 94 that is arranged the same as aperture 80 of panel 22 so as to be concentrically located with the top edge portion 88. It is a feature of the bag 20 of the present invcntion that the bag upper edgings 76 and 86 be in congruent relation and that the apertures 84 and 94 also be in congruent relation, with the apertures 84 and 94 also being centered with respect to the length of the bag as measured between its side seams 26 (see FIG. 2).

The result is that when the bag 20 is in its flattened relation, its side panels 22 and 24 are in closely spaced relation, with the gusset 40 being received within and infolded relation between the bag side panels 22 and 24. In addition, the bag side panel top edgings 76 and 86 as well as the handle apertures 84 and 94 are in essentially congruent relation.

A bag 20 in its flattened relation may be readily shifted to its open flat bottom relation; for instance, if such bag 20 has its handle defining apertures 84 and 94 separated and separately grasped by one passing one or more fingers of one's hand through the aperture 84 and grasping the other bag side panel 24 in the same manner with the other hand, and the bag in question moved briskly through the air, the bag open end 72 opens under the ambient air temporarily trapped in the bag, and the pressure of the air involved expands the bag to its open relation in which the center portion of the gusset 40 moves downwardly into roughly the plane of the lower marginal edgings 35 and 36 of the bag side panels 22 and 24, which marginal edgings 35 and 36 also change shape from the side-by-side, substantially parallel, rectilinear form of FIG. 2 to the configurations indicated in FIG. 4, wherein the lower marginal edgings 35 and 36 together form a six sided perimeter that is essentially centered about the bag gusset flattened portion that is diagrammatically illustrated in FIG. 4 at 95. The bag 20 as opened for loading should be placed on a smooth and horizontal supporting surface, such as a counter or the like at a grocery store or discount shopping center checkout center, with the result that the bag 20 is self braced and will stand upright in the open relation shown in FIG. 1 to receive groceries or other purchases made by a customer of the business concern involved. When the bag 20 has been loaded, the customer may grasp same by passing one or more fingers of one hand through the centrally located apertures 84 and 94, which closes the top of the bag over the bag contents, permits the holder of the bag to confidentally carry the bag and its load as needed. When the bag is disposed on a table or the like for unloading, the bag automatically returns to its open relation shown in FIGS. 2, 3 and 4, for ready access to the contents of the bag for unloading purposes. After unloading, the bag may be returned to its flattened relation of FIG. 2, for storage and further use, by one grasping the opposite ends 28 and 30 of the bag with his hands, respectively, below the in-fold line 46 of the bag gusset 40, and pulling his hands apart, to remove the flattened shaping of the bag at its bottom. While the bags 20 are thus reusable, the economics of their manufacture pursuant to the method of the present invention are such that no economic loss is involved in disposing of the bags 20 immediately after their first use.

METHOD OF MAKING THE BAG

Figure 5:
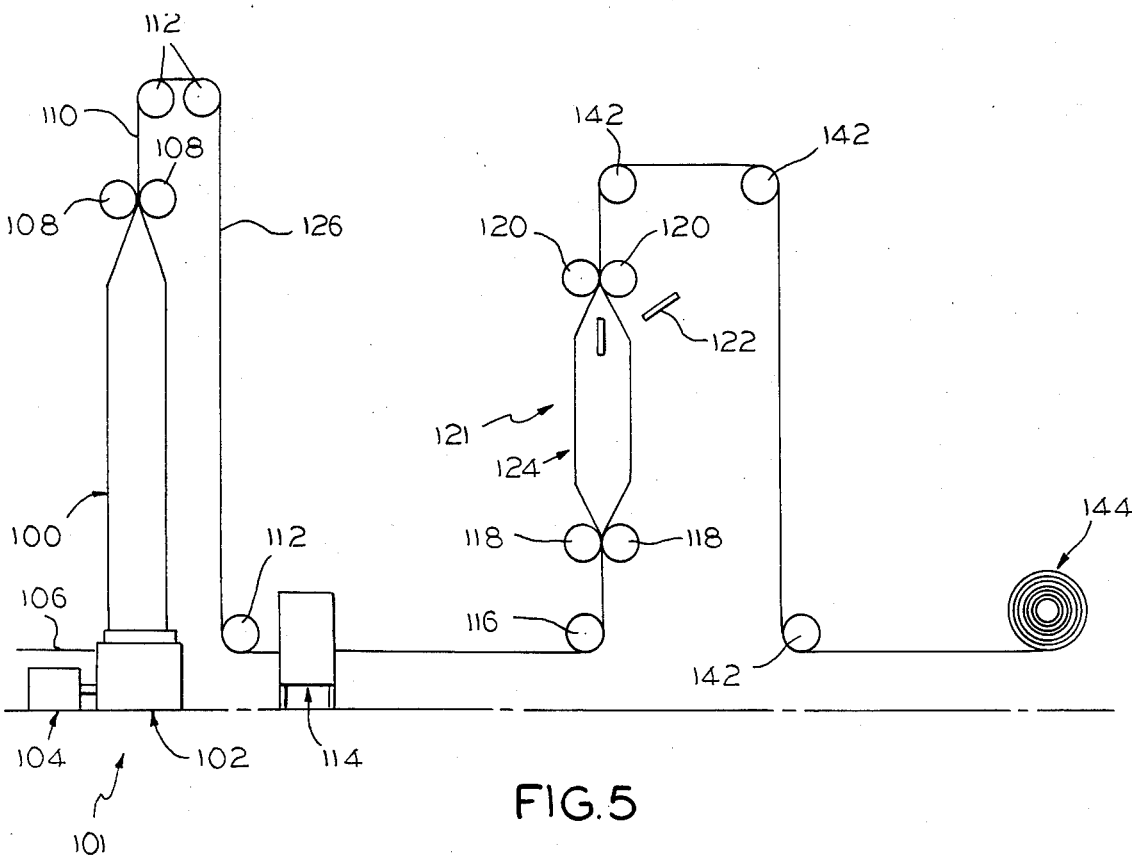
FIG. 5 is a diagrammatic view illustrating schematically the formation and processing of plastic tube stock for forming bags of the type shown in FIGS. 1–4.

Referring now to the diagrammatic and schematic FIG. 5, there is there illustrated the various method steps that may be employed in accordance with the invention to form the tube stock from which the bag 20 is made. As indicated, it is an important feature of the inventon that the bags 20 be formed from tubular bag stock that is formed from one of the materials that have been indicated to have a thickness in the range indicated. It is immaterial to the practice of the invention whether or not the tube stock is formed as part of the apparatus set up to practice the invention, or whether or not the tube stock is previously formed (as herein disclosed), rolled up, and then at a later time unrolled for processing in accordance with the method steps of the present invention.

In the form shown in FIG. 5 plastic tubing 100 is formed at a tube stock forming station 101 by a suitable blown film process utilizing a blowing die 102 of any suitable commercially available type, a suitable extruder 104 for supplying plastic material of the type indicated to the blowing die 102, and a source of air pressure to which a suitable conduit 106 is connected, with the conduit 106 being in suitable communication with the die 102 for forming a continuous seamless plastic film tube 100 in accordance with any state of the art technology on this subject. For purposes of disclosure, the tube 100 after its formation is shown to be collapsed into flattened relation by a pair of opposed pinch rollers 108 (after the plastic material defining the tube 100 is sufficiently cooled and solidified to form the basic tube 100). The pinch rollers 108 thus form the basic tube stock 110 from which the bags 20 are to be formed in accordance with the present invention, with the tube stock 110 being flattened transversely of same from one side edge to the other side edge of same, to define a flattened tubular wall structure 126.

The arrangement of FIG. 5 illustrates the tube stock 110 being passed around suitable idler rollers 112, with the tube stock 110 then being passed through a suitable printing station 114 where any needed indicia or decoration are printed on the exterior surfacings of the tube stock flattened side walls that will form the respective bag side panels 22 and 24.

In accordance with the present invention, the tube stock 110 moves on to the next stage of its processing, as around idler roller 116, to pass between the oppositely acting pinch rollers 118, where it is reinflated by a standing or stationary column of air which is trapped between the sets of pinch rollers 118 and the downstream located set of pinch rollers 120 at inflating station 121. The source of air pressure involved (not shown) is placed in communciation with the nozzle 122 that is initially inserted through a suitable puncture made in the tube stock to inflate same (the leading end of the tube stock 110 having been initially fed through rollers 118 and 120 for this purpose) as indicated diagrammatically in FIG. 5, whereupon the nozzle 122 is withdrawn and the tube stock resealed prior to start up of further feeding or driving of the tube stock 110 beyond pinch rollers 120 of station 121. This forms inflated stationary portion 124 of the tube stock 110.

Figure 6:
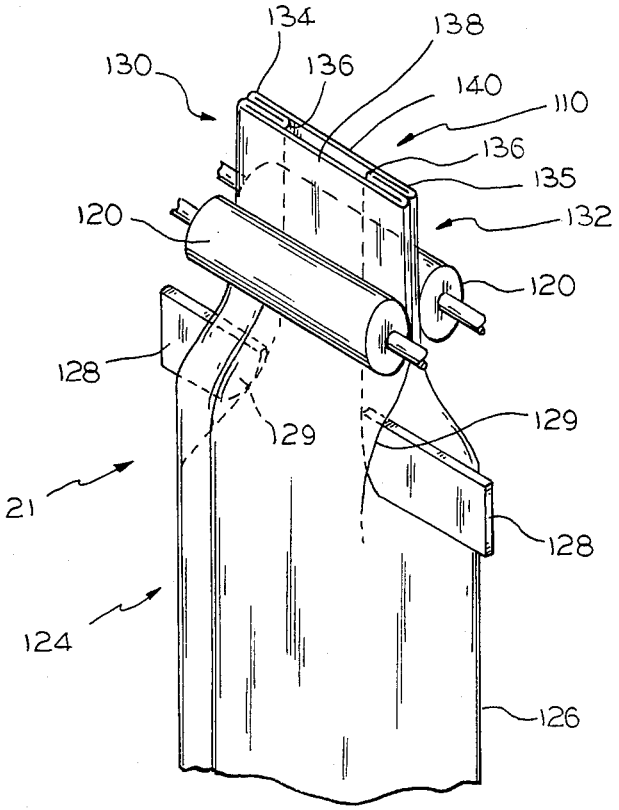
FIG. 6 is a diagrammatic perspective view in somewhat of a schematic form illustrating the manner in which the tube stock has the opposed pleats formed in its side edgings that, in accordance with the present invention, become the bottom gussets of the bag of the present invention.

As the tube stock 110 moves through the tube stock inflated portion 124, a feature of the invention is that the wall structure 126 defining same is formed to define side pleats 130 and 132 on either side of the wall structure 126. In practice this may be done by providing at station 121 the opposed or oppositely directed pleat forming die plates that are fixedly mounted in any suitable manner relative to the tube stock wall structure 126 so that when the inflated portion 124 is inflated and the tube stock fed through same, the opposed ends 129 of the respective forming die plates 128 reshape the tube stock wall structure 126 to define the respective side pleats 130 and 132 that (downstream of station 121) thus extend longitudinally of the tube stock 110 along either of the respective side edgings 134 and 135 of same. It will be observed from FIG. 6 that the respective side edge pleats 130 and 132 are similar in nature and comprise an inwardly extending fold 136 of the wall structure 126 which is disposed between the respective tube stock wide side portions 138 and 140 that are disposed in close adjacency to each other with the folds 136 in infolded relation therebetween, as indicated in FIG. 6. Thus, the edgings 134 and 135 in essence are pleats that, in accordance with the invention, are maintained through the remainder of the processing steps effected on the tube stock 110 to form the gussets 40 of the individual bags 20.

After the shaping of the tube stock 110 to the shape indicated in FIG. 6 as it leaves the pinch rollers 120, the tube stock 110 continues moving longitudinally thereof, as over idler rollers 142, roll up to form stock roll 144 that may be stored for further processing of the tube stock 110, as needed, to form bags 20 in accordance with the invention.

As previously indicated, the individual bags 20 are to be formed out of the tube stock 110 in a waste free manner, with the tube stock 110 being drawn from tube stock roll 144 at a separate facility utilizing the method steps diagrammatically and schematically by FIGS. 7–11. As there illustrated, the individual bags 20, as shaped from the wall structure 126 of the tube stock 110, (that is flattened to the side pleated form shown in FIG. 6 to define the pleats 130 and 132 extending along the edges 134 and 136 of same), are formed in pairs that extend transversely of the tube stock 110; the bags 20 that are to be formed on the side edge 134 of the tube stock having the pleat 130, including a segment of such pleat to form the bottom of the bag, and the bags 20 to be formed on the other side edge 135 of the tube stock 110 having the pleat 132, including a segment of such pleat 132 to form the bottom of such bags 20. Thus, the segments of the respective side edges pleats 130 and 132 that are a part of the respective bags 20 form the gussets 40 of same. Further, the ends 28 and 30 of the respective bags when formed are to extend transversely of the tube stock 110, and the bags 20 that are to be formed along either side edge 130 and 132 of the tube stock 110 are initially staggered in the interfitting relation that is indicated in FIG. 11, for the parts of same that are to form the open tops of the bags 20. As brought out by FIGS. 8 and 11, the tube stock 110 as part of the formation of the bags 20 therefrom, is split into two webs A and B along a severance line 150 of sine wave configuration, and with web B being trained through suitable take-up roller assembly 152 and returned to the processing plane of web A, so as to delay or shift the positioning of web B relative to web A one-half a bag width (the location of the bag ends to be formed in the respective webs A and B are diagrammatically illustrated in FIG. 11 by the transversely extending dashed lines 26), so that a bag 20 may be formed simultaneously from each web A and B (by heat seal cutting) at the leading ends of webs A and B.

In the showing of top plan view FIG. 11, at the right end of same, the two transversely adjacent bags 20 at either side edge of the tube stock 110 are shown in full lines (these are the bags 20 formed from the respective webs A and B), while dashed lines 26 indicate remaining bags 20 to be formed out of the tube stock 110. 10.

It is also pointed out that for the particular height of bags 20 that are to be formed from the tube stock webs A and B that are illustrated in FIGS. 8 and 11, the hand hold forming apertures 80 and 94 of the bags 20, that are to be formed along one side edge 130 of the tube stock 110, are formed in congruent relation to define tube stock through openings 140, while the similarly congruently aligned handle forming apertures 80 and 94 of the bags 20 to be formed on the other side edge 132 of the tube stock 110 are to form tube stock through openings 142. Furthermore, the tube stock through openings 140 are aligned longitudinally of the tube stock web A and to one side of the alignment of the through openings 142 longitudinally of the tube stock, to accommodate the heretofore disclosed formation of the apertures 80 and 94 of the individual bags 20; through openings 142 are similarly aligned with web B.

And, as has been previously brought out, the gussets 40 of each bag 20 at the lower end of the bag are to be heat sealed adjacent either end of the bag to define the respective diagonal heat seals 54, 56( 58 and 60 adjacent either end of the bag, with these diagonal heat seals being so referenced in FIG. 11.

The processing of the tube stock 110 as it is drawn from roll 144 is effected as suggested by FIGS. 7–11.

Referring now more specifically to FIGS. 7–11, FIG. 7 diagrammatically illustrates a tube stock movement control station 160, to which a tube stock roll 144 (of which the tube stock 110 has been processed and rolled up as described in connection with the showing of FIGS. 5 and 6) has been conventionally applied, which station 160 may be made up of suitable conventional devices that provide for movement control of the tube stock 110 from the roll 144 to the stations indicated in FIG. 8. Station 160 may also be arranged to provide for a tube stock inflating station 121 if the tube stock wound on roll 144 has not been formed to define the indicated side pleats 130 and 132 (see FIG. 6).

FIG. 8 diagrammatically illustrates the various stations and mechanisms that may be employed to practice the method of the present invention in forming the individual bags 20. Diagrammatically illustrated in FIG. 8 are a tube stock through opening forming station 162, at which the through openings 140 and 142, that have been referred to in connection with the showings of FIGS. 10 and 11, are formed in the tube stock 110. The next station of FIG. 8 is the diagonal heat weld forming station 164 that forms the four diagonal heat seals 54, 56, 58 and 60 of the individual bags 20. Station 164 is located upstream of the tube stock splitting station 166 at which the tube stock splitting function of the diagrammatically illustrated apparatus of FIG. 8 is performed (see FIG. 11), this being just upstream of the training or movement delay apparatus or assembly 152 for the tube stock web B. Downstream of the training arrangement 152 is tube stock draw station 168, which is upstream of the bag severing or cut off station 170 that is at the leading end of the tube stock 110; it is at station 170 that the individual bags 20 to be formed from the tube stock 110 are cut off from the respective webs A and B involved to form the bags 20 in pairs as well as form the end seals 26 of the individual bags 20.

Figure 9:
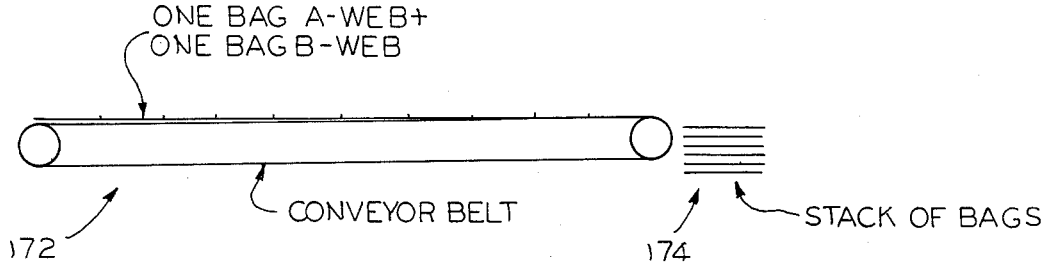
FIG. 9 is a view similar to that of FIG. 8 illustrating one way of carrying away from the apparatus of FIG. 8 bags formed by the practice of the present invention, and stacking same for use or packaging, as desired.

The individual completed bags 20 then move on to suitable conveyor station 172 where the bags formed from each tube stock web A and B are conveyed or suitably deposited at a bag stacking station 174 (see FIG. 9).

In the general arrangement diagrammatically illustrated in FIGS. 7–11, an intermittent movement action of the tube stock 110 through stations 162, 164, 166, 168, and 170 is contemplated, with the tube stock draw station 168 comprising suitable draw rollers 180 and 182 that are incorporated in a suitable intermittently operated actuating mechanism to continuously grip the webs, and in a suitable time sequence, feed the webs A and B, and thus the tube stock 110, one bag width, and then stop the feeding action, following which the stations 162, 164, and 170 are suitably operated, simultaneously or in a suitable sequence, to respectively form the bag through openings 140 and 142, form the bag diagonal seals 54, 56, 58, and 60, and sever the individual bags 20 being formed from each web A and B, from the tube stock 110, and also form the end seals 26 of each bag.

Referring now more specifically to the tube stock movement control station 160, the tube stock roll 144 is journaled in any suitable manner in conventional braking relation with a conventional canvas drag brake device 190 that may conveniently take the form of a canvas sheet 192, suitably fixedly mounted at its upper end 94 and carrying a suitable weight 96 at its lower end 193, and draped against the tube stock 110 adjacent to where it is drawn off roll 144.

Figure 7:
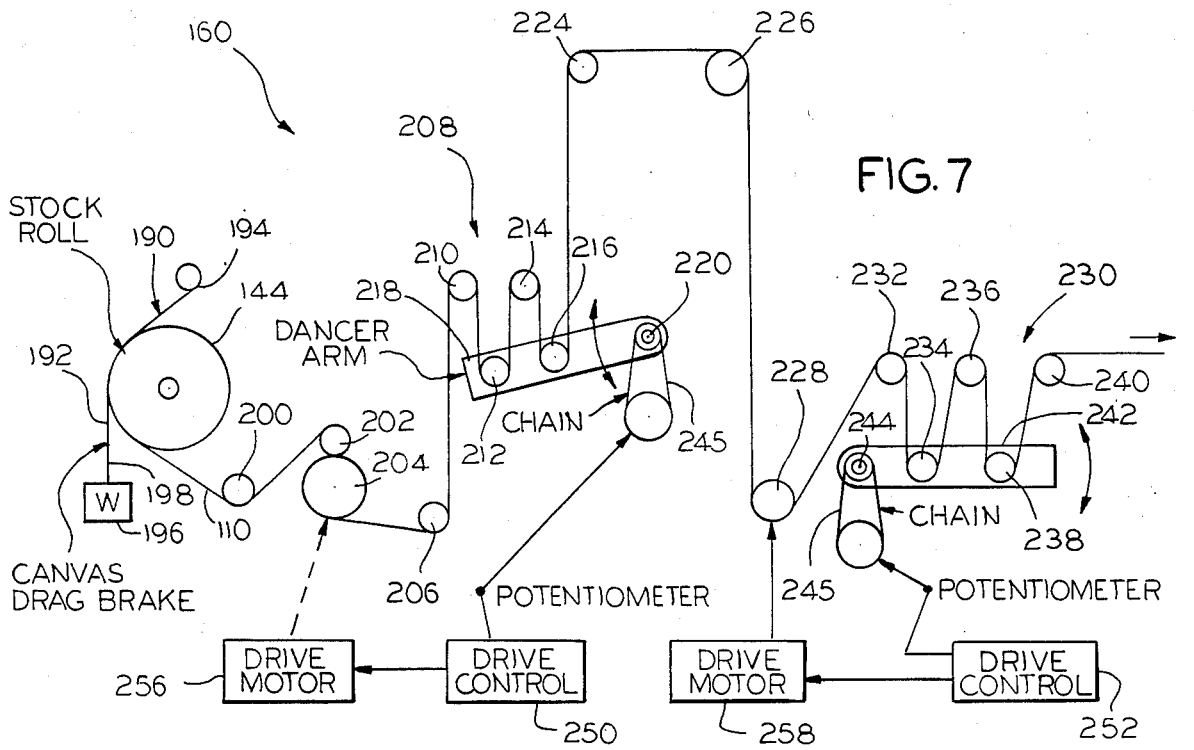
FIG. 7 is a diagrammatic view similar to that of FIG. 5 illustrating one way of feeding the tube stock to the diagrammatically illustrated apparatus of FIG. 8 that forms the bags in accordance with the method of this invention.

The tube stock 110 drawn from roll 144 is trained about idler rollers 200 and 202, thence about drive roller 204, and idler roller 206 to a familiar type of dancing arm take up mechanism 208, where the tubular stock is trained over rollers 210, 212, 214, and 216 in the manner diagrammatically indicated in FIG. 7, with the rollers 210 and 214 being journaled for elevation change free rotating action, while the rollers 212 and 216 are suitably journaled on the dancer arm 118 that is to swing about pivot axis 220.

From the mechanism 208 the tube stock 110 is shown to be trained over idler rollers 224 and 226, and drive roller 228 from which the tube stock is applied to a second dancing arm take up device 230, with its rollers 232, 236, and 240 being of the type similar to rollers 210 and 214, and the rollers 234 and 238 being suitably journaled on the dancing arm 242. Arm 242 swings about pivot axis 244. Both the mechanisms 208 and 230 are conventionally actuated through the respective drive pulleys or chains 245 that transmit to the respective arms 218 and 242 the actuation provided by the suitable respective drive controls 250 and 252 that act in a conventional manner through the respective indicated potientiometers to control the actuation thrust applied to the respective arms 218 and 242 by way of the respective drive transmitting conductors 245. The respective drive controls 250 and 252 also are suitably conventionally connected to the respective drive motors 256 and 258 that drive the respective drive rollers 204 and 228 in a suitable conventional manner.

The function of the take up devices 208 and 230 is to take up and let out the tube stock 110 in accordance with the intermittent operating functioning of the drive rollers 180 and 182 of the draw station 168, with which the respective drive controls 250 and 252 are suitably and conventionally operably connected for effecting the take up and let out of the tube stock as required by the intermittant tube stock feeding action of the drive rollers of the draw station 163.

If so desired, a tube stock inflating station and side pleat forming arrangement comparable to those shown in FIGS. 5 and 6 may be applied between the idler roller 226 and the drive roller 228 where the tube stock 110 being drawn from roll 144 does not have the hereinbefore referred to side pleats 130 and 132 formed therein, as already mentioned.

Under the intermittent drawing action on the tube stock at station 168, the tube stock proceeds intermittently through the bag opening forming station 162, the bag diagonal heat seal forming station 164, and the tube stock splitting station 166, with both the tube stock webs A and B proceeding through the draw station 168, the web B first proceeding through the take up or movement delay assembly 152. As indicated, the draw rollers 180 and 182 function to feed the tube stock webs one bag width forwardly or to the right of FIG. 2, during which action the cutting blade or razor 167 at tube stock station 166 operates to form the tube stock severance edging 150 (see FIG. 11) that ultimately define the upper marginal edgings 76 and 86 on each bag that is severed from the tube stock (see FIG. 1). During the period of "dwell" that occurs between the forward movement of the tube stock 110 to the right of FIG. 8 (that is effected by the draw rollers 180 and 182 of draw station 168), the diagrammatically illustrated equipment at the respective stations 162 and 164 operates to form the bag through openings 140 and 142 and the bag diagonal heat seals 54, 56, 58, and 60.

With regard to the through opening forming station 162, a pair of conventional air cylinder devices 270 and 272 are stationarily mounted substantially vertically to actuate their respective circular cutters 274 and 276. The air cylinder device 272 and its cutter 276 is disposed with regard to the movement path of the tubular stock 110 to form the through openings 140 by pressing the cutter tool 276 into aperture 280 of stationary plate 282.

Similarly, the air cylinder device 270 and its cutting tool 274 is located with respect to the movement path of the tube stock 110 through station 162 to form the through openings 142 of the bags; here again, for illustrative purposes the air cylinder device 270 effects this operation by pressing cutting tool 274 into aperture 284 of the stationary plate 282. Plate 282 is suitably supported at the location under tube stock 110 to properly locate its aperatures 280 and 284 in vertical alignment with the desired location of through openings 140 and 142 to be formed in the tube stock (for each bag 20 to be formed therefrom), and, of course, the respective cylinder devices 270 and 276 and their respective cutting tools 274 and 276 are positioned to operate as indicated to form the respective through openings 140 and 142 in pairs having the staggered relation indicated in FIG. 10.

At the station 164, two sets of air cylinder devices 290 are located above the tube stock 110, on either side edging 134 and 135 of same, and each such air cylinder device 290 actuates a diagonal seal forming hot seal head 292 conventionally formed to form the diagonal heat seals 54 and 56 (where indicated in FIG. 10) on the upwardly facing surfacing of the tube stock 110. Mounted below the respective sets of air cylinders 290 and their respective heads 292 are similarly located air cylinder devices 292 and their cooperating diagonal seal heads 296 that are the same as heads 292, though it is to be understood that the heads 292 and 296 move in opposite directions during the diagonal seal formation at station 196 to compress the respective infolded side edgings 134 and 135 of the tube stock, in forming the diagonal seals 54, 56, 58, and 60, against the respective die plates 300 and 302 that are respectively disposed within the tube stock respective side pleats 130 and 132 to insure separation of the opposed sets of diagonal seals across the respective side pleats 130 and 132 in the bag forming operation indicated. Plates 300 and 302 are suitably stationarily mounted in the relative positions suggested in FIG. 10, and preferably are Teflon coated on both sides and heated to provide increased speed of operation. One set of the upper and lower air cylinder devices 290 and 294 and their respective heads 292 and 296 cooperate with one of the die plates 300 in forming diagonal seals 54 and 56, and a second set of the air cylinder devices 290 and 294 and their respective heads cooperate with the other of the die plates 302, in forming diagonal seals 58 and 60 all in a conventional manner, and with the orientation to properly locate the respective sets of seals 54, 56, 58, and 60 on the tube stock for each bag 20 to be formed therefrom in providing bags 20 arranged as shown in FIGS. 1–4.

At the tube stock station 166, razor or other suitable tube stock cutting blade 167 is suitably mounted in any suitable manner to provide the sine wave type movement, sidewise of the tube stock, that provides the sine wave like tube stock splitting or severing line 150 shown in FIG. 11, on movement of the tube stock to the right of FIGS. 8 and 11 by operation of the draw station 168.

The take up arrangement 152 for web B comprises a pair of suitably journaled upper rollers 310 and 312 and a lower suitably journaled roller 314, with the web B of a tube stock 110 being trained over same in the manner indicated so as to shift or delay the forward movement of the web B exactly a one-half width of a bag 20 being formed so that downstream of the arrangement 152, the webs A and B proceed toward the bag severing station 170 at the positions where the side edges that are to be formed at 26 of the bags 20 to be formed at each side edging 134 and 135 of the tube stock 110 (see FIGS. 1, 2, and 11) will be aligned transversely of the tube stock 110 (see FIG. 11 at station 170).

The bag severance station 170 comprises cross bar 329 suitably vertically actuated and provided with a pair of hot seal forming elements 330 that each have a length equivalent to the lengths of the side seals 26 that are to be formed in the single bags of the respective tube stock webs A and B when the cross bar 329 is depressed against suitable lower seal roller 332 having a central axis 334 with which the respective blades 330 are aligned. Cross bar 329 is conventionally actuated in any suitable manner and in a time sequence consistent with the operation of the tube stock draw equipment at station 168.

Receiving the severed bags 20 from the station 170 is the constantly operating belt conveyor 172 that consecutively carries the respective sets of bags 20 (each formed simultaneously from the leading ends of webs A and B by the operation of the equipment at station 170) for stacking or other form of storage at stacking station 174 (see FIGS. 8 and 9). The conveyor 172 may be of any suitable type and powered in any suitable manner, it being only diagrammatically illustrated as its specifics really have nothing to do with the present invention. Conveyor 172 is, of course, powered to be driven consistent with the operation of the equipment at station 168.

As will be clearly apparent to those skilled in the art, the various stations diagrammatically illustrated in FIGS. 5–11 may be arranged in any conventional and convenient manner to effect the support feeding, and processing action on the tube stock that is consistent with the method of the present invention, in accordance with current technology on this subject, and as may be required or be desirable for a particular installation for making bags 20.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. A flat bottom bag of integral one piece construction formed from heat sealable tubular plastic material, said bag comprising:

a pair of single ply side panels that are integrally joined together along and across the bag bottom by a continuous gusset having a central fold line that is, in the flattened relation of the bag wherein said bag side panels are in closely spaced relation, centrally disposed between the lower portions of said bag side panels within the bag bottom, said gusset and said side panels being of sustantially the same dimension across the length of said bag, said gusset between the respective bottom edgings of said bag side panels and said central fold defining a pair of in-fold panels, one of which opposes the lower portion of one of said bag side panels of said bag to form a pair of adjacent bag plies in said flattened relation of said bag, and the other of which opposes the lower portion of the other of said bag side panels to form a second pair of bag plies in said flattened relation of said bag, with said bag side panels being integrally joined together along the ends of the bag by rectilinear heat seal seams that extend generally normally of said gusset, with said first pair of bag plies being joined together free of adherence to said second pair of bag plies along heat seals that extend diagonally from adjacent said bag ends to adjacent the bottom edging of said bag one side panel, and with said second pair of bag plies being joined together free of adherence to said first pair of bag plies along heat seals that extend diagonally from adjacent said bag ends to adjacent the bottom edging of said bag other side panel, said bag ends extending substantially through said gusset adjacent the bag bottom, with said gusset being imperforate between said bag ends, said bag side panels being formed to define congruent upper end portion that include convexly contoured parabolically shaped top edges that are centered relative to the length dimension of said bag and that are formed to define congruently located apertures for forming hand holds for the bag, with said bag top edges being free of each other for forming the open end of said bag, and said bag ends terminating at said top edges at either end of the bag, equidistantly from said gusset fold line, said bag side panel convexly contoured top edges defining bag top portions with said apertures centered therein in substantial coaxial relation thereto, and the distance heightwise of the bag between the level of said bag end terminations and said apertures significantly exceeding the distance heightwise of the bag between said apertures and top edges of the bag at said bag top portions.

2. The flat bottom bag set forth in claim 1 wherein:

said apertures are circular, and are located in substantial concentric relation with said bag side panel top edges.

3. The method of forming a plurality of flat bottom bags from a length of flattened plastic film tube stock defining a band having a pair of opposed tube stock side walls integrally joined by a pair of tube stock opposite side edgings that are spaced apart transversely of the tube stock, said method comprising:

forming along each of said edgings a continuous in-fold pleat whereby first and second in-fold tube stock plies are formed along and within each of said tube stock side edgings, heat sealing together, at and along each of said tube stock edgings, said first and second plies and along pairs of spaced diagonal heat seals that, for each pair of such heat seals, converge in direction of the respective edgings, with said first plies of each edging being disposed to be free of adherence to said second plies thereof along the respective edgings, and heat seal forming the bags in the tube stock along heat seal lines that extend transversely of the tube stock and for each bag intersect like portions of the respective diagonal heat seal pair for each bag, wherein in the heat seal forming of the bags, consecutive bags that are formed along the tube stock band are oppositely disposed crosswise of the band with each such bag having its bottom centered on a pair of said converging heat seals and its ends defined by the pair of transversely extending heat seal lines that respectively intersect the diagonal heat seals of the bag, wherein in the heat seal forming of the bags, the formation of bags that are adjacent transversely of the tube stock is such as to make such bags of equivalent widths, and wherein in the heat seal forming of the bags, the bags having their bottoms along one of said tube stock edgings are initially staggered ahead of the bags having their bottoms along the other of said tube stock edings, with the tube stock being split into separate webs, and one of the webs having its forward movement delayed, to bring the side edgings of the bags that are adjacent transversely of the tube stock into alignment.

4. The method set forth in claim 3 wherein:

in the heat seal forming of the bags, each bag is formed to define an openable top extending between said transversely extending heat seal lines of each bag, said openable top of each bag being defined by congruent tube stock side wall portion shaped to define convexly contoured parabolically configured bag top edges that are centered relative to the bag diagonal heat seal pair, and congruently located circular apertures that are in substantial concentric relation with said parabolically configured bag top edges.

* * * * *